US006736630B1

(12) United States Patent
Miyanaga

(10) Patent No.: US 6,736,630 B1
(45) Date of Patent: May 18, 2004

(54) SAFETY SWITCH ASSEMBLY FOR LIGHTER

(76) Inventor: Tsuneo Miyanaga, No. 13, Alley 36-1, Lane 210, Sec. 1, Jush Rd., Lungjing Shiang, Taichung (TW)

( * ) Notice: Subject to any disclaimer, the term of this patent is extended or adjusted under 35 U.S.C. 154(b) by 3 days.

(21) Appl. No.: 10/453,299

(22) Filed: Jun. 3, 2003

(51) Int. Cl.[7] ..... F23Q 2/28; F23D 11/36
(52) U.S. Cl. ..... 431/153; 431/132; 431/255
(58) Field of Search ..... 431/152, 153, 431/132, 255, 253, 277, 129, 344

(56) References Cited

U.S. PATENT DOCUMENTS 3,734,680 A * 5/1973 Maruyama ..... 431/132
3,817,691 A * 6/1974 Tatsumi ..... 431/255
6,171,099 B1 * 1/2001 Lin ..... 431/153
6,186,772 B1 * 2/2001 Huang ..... 431/132
6,551,097 B1 * 4/2003 Huang ..... 431/153
6,612,832 B1 * 9/2003 Huang ..... 431/153

* cited by examiner

*Primary Examiner*—James C. Yeung
(74) *Attorney, Agent, or Firm*—Alan Kamrath; Rider Bennett, LLP

(57) ABSTRACT

A lighter includes a casing with liquid gas received therein and an igniting member is located in the casing for igniting the gas released from a light hole in a top of the casing. An activation piece is pivotably connected between two walls of the casing and a cap is connected to the activation piece and engaged between the two walls of the top of the casing. A stop is located at an edge of the cap and contacts an edge of the casing to prevent the cap from being pushed before it is slid to skip the stop from the edge of the casing.

3 Claims, 4 Drawing Sheets

SAFETY SWITCH ASSEMBLY FOR LIGHTER

FIELD OF THE INVENTION

The present invention relates to a switch assembly for a lighter and includes an activation piece which is pulled backward first before ignition.

BACKGROUND OF THE INVENTION

A conventional lighter generally includes a roller which is connected to a flint and liquid gas is received in the casing of the lighter. The gas is ignited by rolling the roller which scraps on the flint so as to generate a spark which fires the gas particles when a valve control lever is pressed. The gas particles becomes a flame which continues by the gas particles coming out from the light hole on the top of the casing while the vale control lever is pushed. The roller includes rough surface which hurts the user's thumb and it could be jammed after being used a period of time.

An improved lighter employs an electric switch which includes a button and the user simply pushes the button to ignite the gas. Nevertheless, it involves an inherent shortcoming which is that the lighter can be used by any child because there is no safety device to prevent any unintentional operation of the button and this is dangerous.

U.S. Pat. No. 3,817,691 discloses a lighter that has a manupulatable body 11 which is pressed as shown by the arrow in FIG. 1 of U.S. Pat. No. 3,817,691 and the striker 21 is then pivoted to push the igniter 2. It is noticed that this mechanism for driving the striker involves a complicated mechanism and a lots of small parts. The relative position relationship between the pin member 26 and the cam lever 31 changes within a wide range of distance, and this includes a potential risk of disorder of the parts. Besides, the manupulatable body 11 does not have a safety feature to prevent from unintentionally push.

The present invention intends to provide a switch assembly for a lighter wherein the activation piece has to be pulled backward and then pushed down to ignite the gas.

SUMMARY OF THE INVENTION

In accordance with one aspect of the present invention, there is provided a lighter which comprises a casing having a tank for receiving liquid gas therein and an igniting member is located in the casing. A light hole is defined in a top of the casing and communicates with the space.

An activation piece is pivotably connected between two walls of the casing and a cap is slidably connected to the activation piece and engaged between the two walls of the top of the casing. A stop is located at an edge of the cap and contacts an edge of the casing.

The primary object of the present invention is to provide a lighter that has a cap which can only be pushed after the cap is slid aside so as to prevent any unintentional operation.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
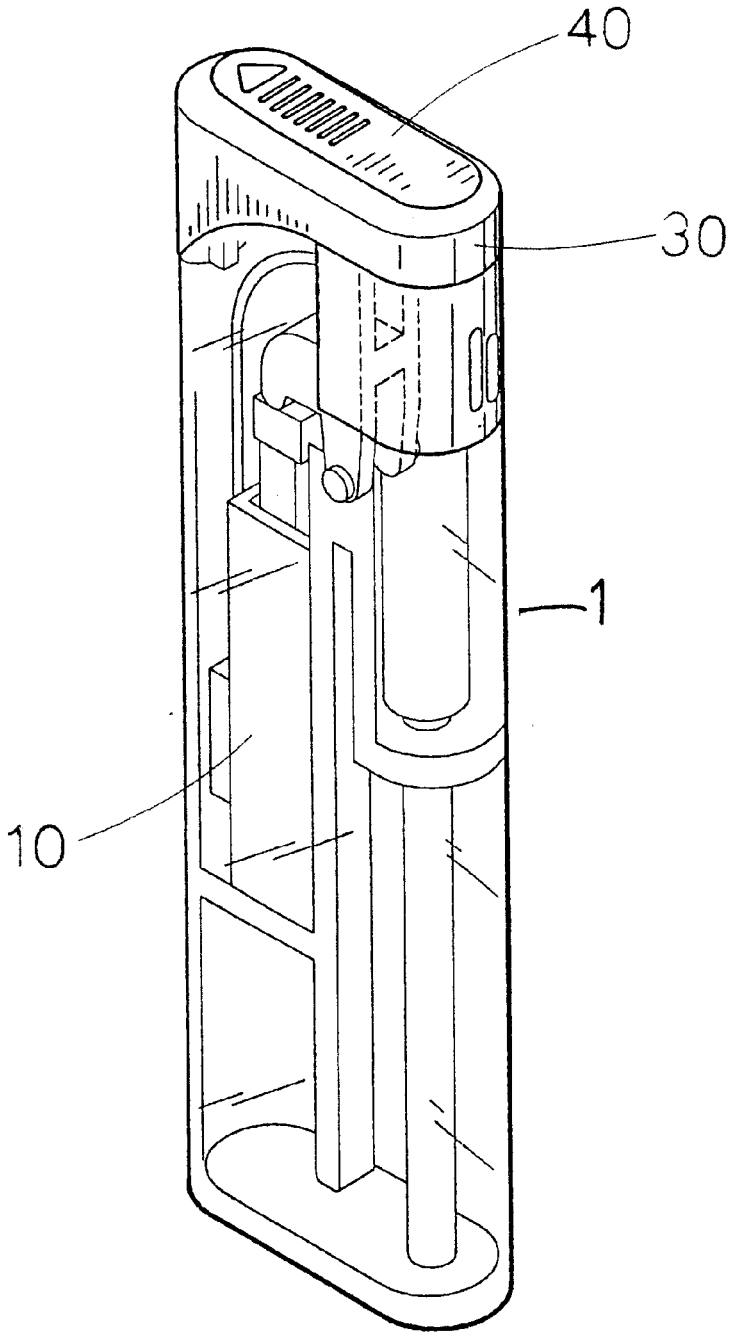
FIG. 1 is a perspective view to show the lighter of the present invention.
Figure 2:
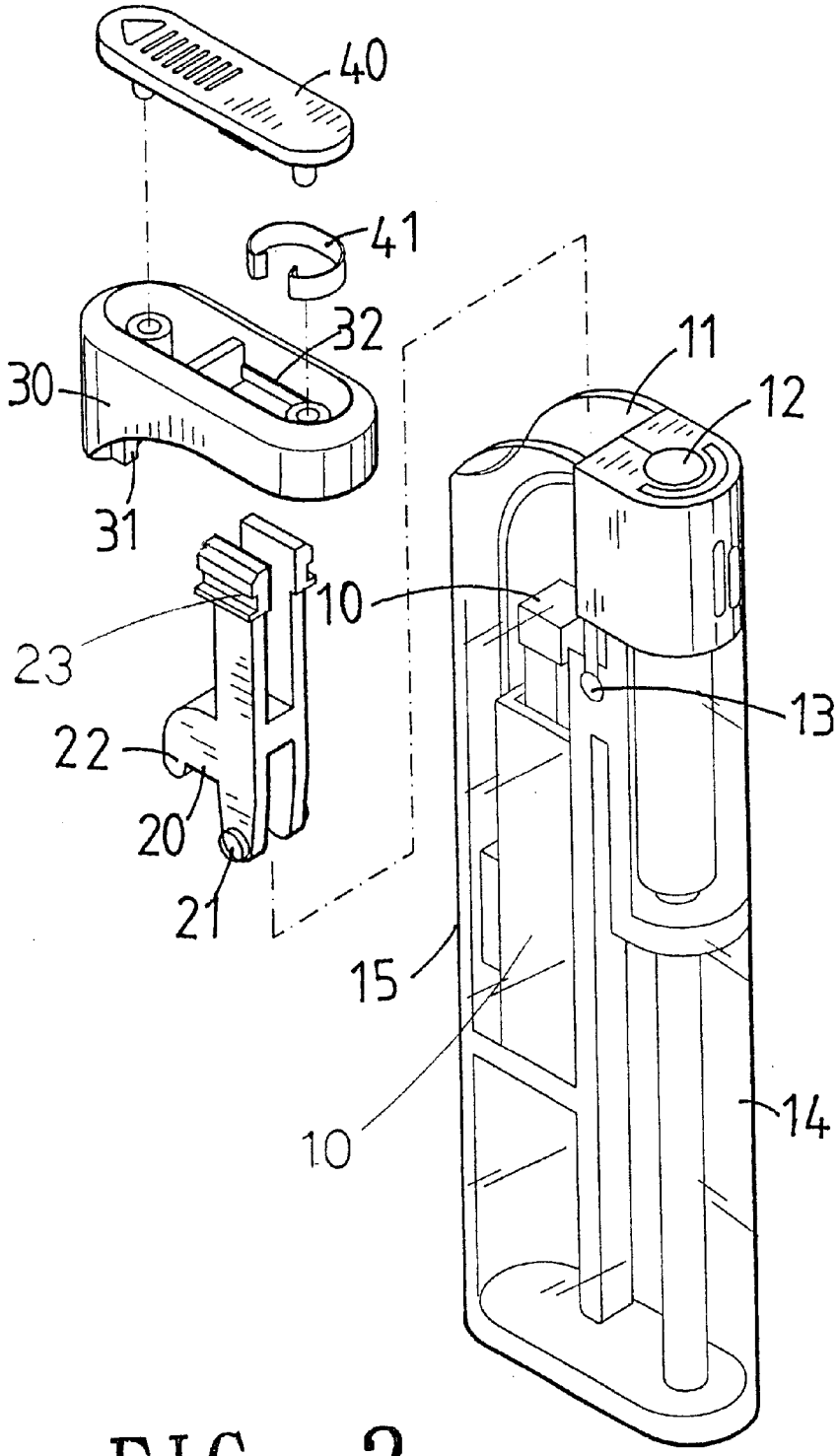
FIG. 2 is an exploded view to show the switch assembly of the lighter of the present invention.
Figure 3:
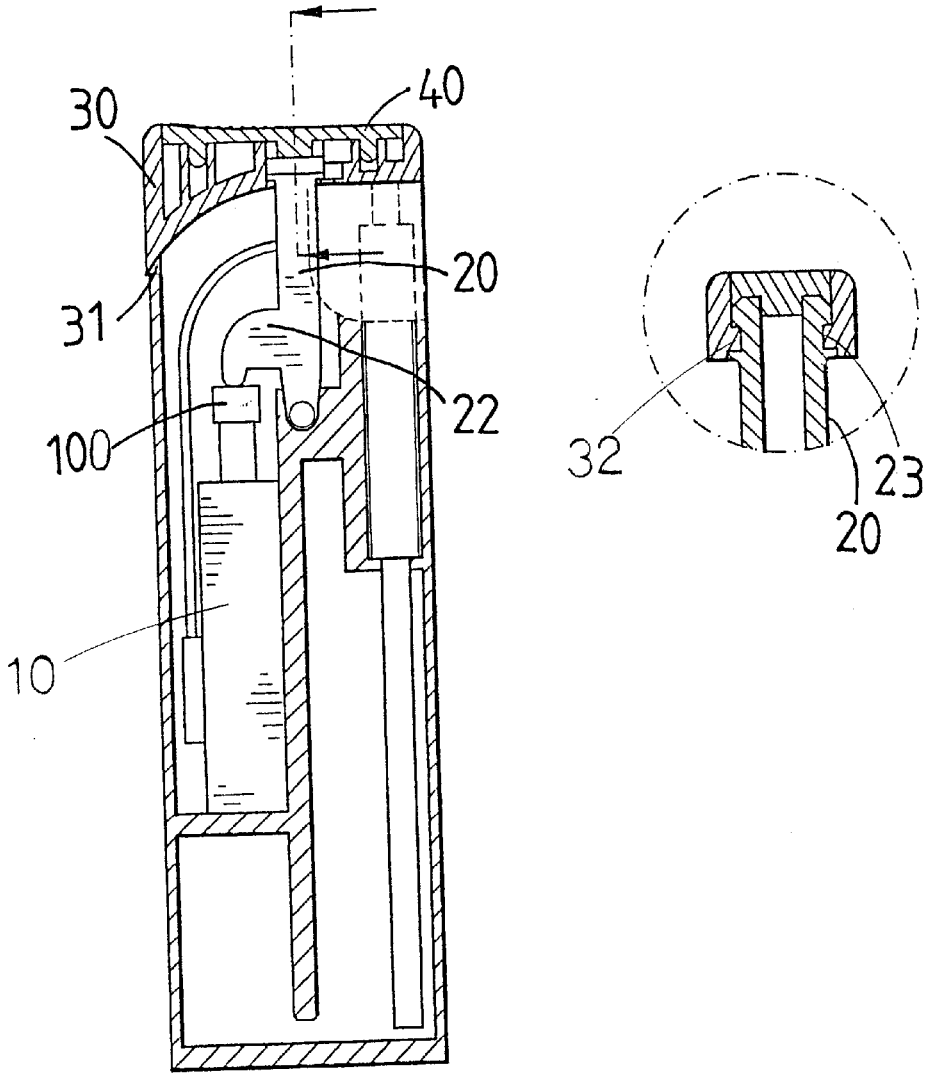
FIG. 3 is a cross sectional view to show the lighter of the present invention.

Referring to FIGS. 1 to 3, the lighter of the present invention comprises a casing 15 which has a tank 14 for receiving liquid gas therein and an igniting member 10 is located beside the tank 14 in the casing 15. The igniting member 10 includes an impact head 100 which is pressed to activate the igniting member 10 so as to generate sparkles to ignite the liquid gas coming out from a nozzle on a top of the tank 14. A light hole 12 is defined in a top of the casing 15 and communicates with the nozzle of the tank 14 via a hose. A recess 11 is defined between two walls and located beside the light hole 12 on the top of the casing 15.

An activation piece 20 has bosses 21 extending from two outsides thereof and the two bosses 21 are pivotably engaged with two concavities 13 in two insides of the two walls of the casing 15. The activation piece 20 includes two elongate plates and each have a groove 23 defined in an outside thereof. A protrusion 22 extends from a side of the activation piece 20 so as to press the impact head 100 of the igniting member 10 when the activation piece 20 is pivoted as shown in FIG. 5.

An elongate loop like cap 30 is connected to a top of the activation piece 20 and engaged between the two walls of the top of the casing 15. Two ridges 32 extend inward from two insides of the cap 30 and are respectively engaged with the two grooves 23 of the activation piece 20 such that the cap 30 is connected with the activation piece 20. A resilient member 41 is connected between the activation piece 20 and the cap 30. A stop 31 is located at a lower edge of the cap 30 and contacts an edge of the casing 15 between the two walls. The stop 31 prevents both the cap 30 and the activation piece 20 from being pressed downward to activate the igniting member 10. A top plate 40 with a friction surface is connected to a top of the cap 30.

Figure 4:
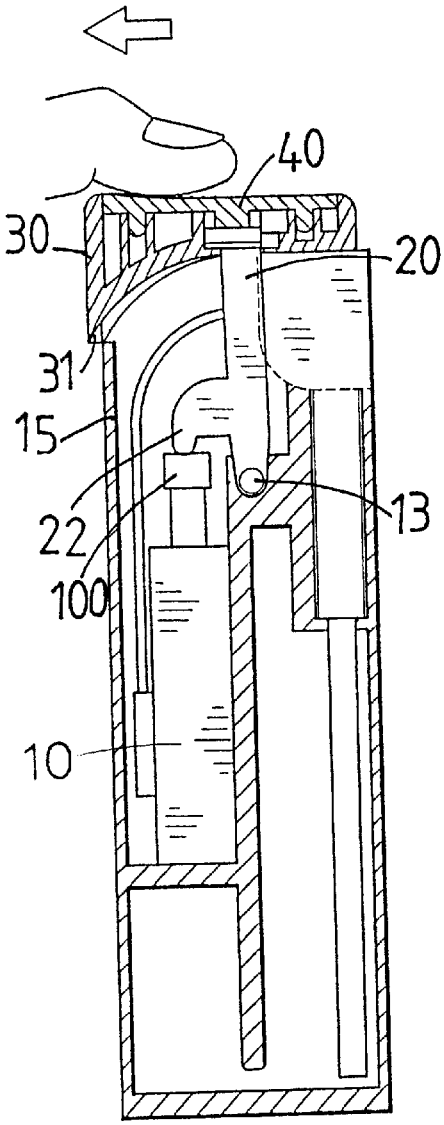
FIG. 4 is a cross sectional view to show the lighter of the present invention wherein the cap is to be slid aside.
Figure 5:
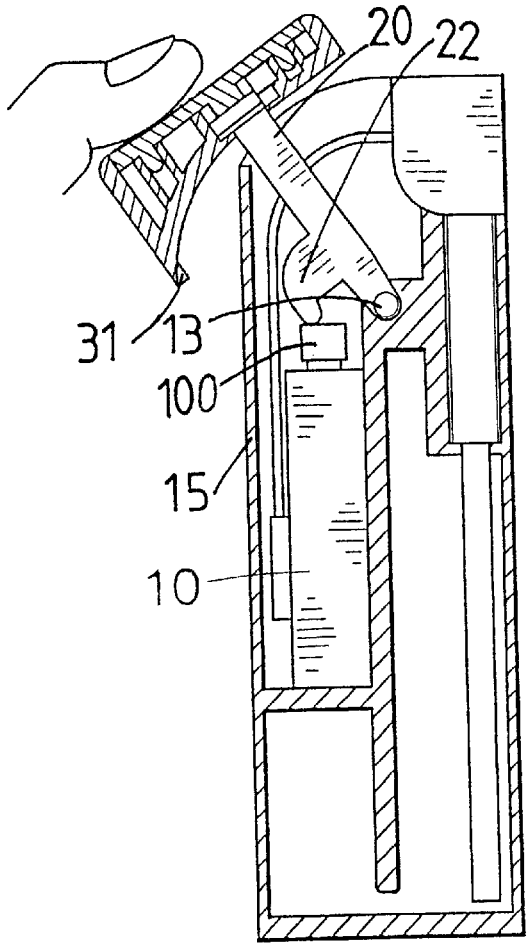
FIG. 5 is a cross sectional view to show the cap is slide and the activation piece is pivoted.

Referring to FIGS. 4 and 5, when using the lighter, the thumb of the user presses on the friction surface of the top plate 40 and then pulls the cap 30 away from the light hole 12 to remove the stop 31 away from the edge of the casing 15. The cap 30 is then pivoted about the bosses 21 so as to pivot the activation piece 20 and the protrusion 22 presses the impact head 100 of the ignition member 10 to generate a spark to ignite the gas released to the light hole 12.

It is noted that the operation of the lighter includes two different directions of actions, the first one is to pull the cap 30 in the direction away from the light hole 12 by moving the cap 30 relative to the ridges 32 which are not moved, and the second action is to pivot the activation piece 20. The first action allows the cap 30 to be able to be pivoted because the stop 31 is disengaged from the edge of the casing 15. In other words, if the first action is not completed, the user cannot pushed downward the cap 30. This two-direction action makes the mechanism to have a safety feature such that the lighter cannot be unintentionally used by kids.

While we have shown and described the embodiment in accordance with the present invention, it should be clear to those skilled in the art that further embodiments may be made without departing from the scope of the present invention.

What is claimed is:

1. A lighter comprising:

a casing having a tank adapted to receive liquid gas therein and an igniting member located in the casing, a light hole defined in a top of the casing and communicating with the tank, an impact head located on a top of the igniting member;

an activation piece pivotably connected between two walls of the casing and including two plates, each plate having a groove defined in an outside thereof and a protrusion extending from a side of the activation piece, the protrusion located above the impact head of the igniting member, and a cap engaged between the two walls of the top of the casing and having two ridges extending from two insides of the cap, the two ridges respectively engaged with the two grooves of the activation piece, the cap being able to be moved relative to the ridges, a stop located at a lower edge of the cap and contacting an edge of the casing between the two walls.

2. The lighter as claimed in claim 1, wherein two bosses extend from two outsides of the activation piece and are pivotably engaged with two concavities in an inside of the casing.

3. The lighter as claimed in claim 1, wherein a resilient member connected between the activation piece and the cap.

* * * * *